US006695666B2

(12) United States Patent
Nikonorov

(10) Patent No.: US 6,695,666 B2
(45) Date of Patent: Feb. 24, 2004

(54) FLYING DISK TOY

(76) Inventor: Igor M. Nikonorov, 151-48 11th Ave., Whitestone, NY (US) 11357

( * ) Notice: Subject to any disclaimer, the term of this patent is extended or adjusted under 35 U.S.C. 154(b) by 0 days.

(21) Appl. No.: 10/020,851

(22) Filed: Dec. 14, 2001

(65) Prior Publication Data

US 2003/0114236 A1 Jun. 19, 2003

(51) Int. Cl.[7] ..... A63H 27/00
(52) U.S. Cl. ..... 446/46; 446/47; 473/575
(58) Field of Search ..... 446/46, 47, 61; 473/575, 576, 570; 244/12.2, 23 C

(56) References Cited

U.S. PATENT DOCUMENTS

| | | | | |
|---|---|---|---|---|
| 3,673,732 A | * | 7/1972 | Liotta | 446/46 |
| 3,720,018 A | | 3/1973 | Peterson et al. | |
| 3,786,246 A | | 1/1974 | Johnson et al. | |
| 3,802,117 A | * | 4/1974 | Engelhardt | 446/46 |
| 3,948,523 A | | 4/1976 | Michael | |
| 4,077,155 A | | 3/1978 | Bruntmyer | |
| 4,145,839 A | | 3/1979 | Sampietro | |
| 4,209,936 A | | 7/1980 | Sklar | |
| 4,253,269 A | | 3/1981 | Sullivan | |
| 4,254,575 A | | 3/1981 | Gould | |
| 4,301,616 A | | 11/1981 | Gudgel | |
| 4,307,538 A | | 12/1981 | Moffitt | |
| 4,431,196 A | | 2/1984 | Kutnyak | |
| 4,515,570 A | | 5/1985 | Beltran | |
| 4,778,428 A | | 10/1988 | Wield | |
| 4,802,875 A | | 2/1989 | Cunningham | |
| 4,846,749 A | | 7/1989 | Petko | |
| 4,955,842 A | | 9/1990 | Marcotti | |
| 5,032,098 A | | 7/1991 | Balogh et al. | |
| 5,055,080 A | | 10/1991 | Cwalinski et al. | |
| 5,080,623 A | | 1/1992 | Stein | |
| 5,275,417 A | | 1/1994 | Seymour | |
| 5,324,223 A | | 6/1994 | Yang | |
| 5,520,565 A | | 5/1996 | Ulysse | |
| 5,536,195 A | | 7/1996 | Stamos | |
| 5,611,720 A | | 3/1997 | Vandermaas | |
| 5,954,297 A | | 9/1999 | Bukur | |
| 6,106,355 A | | 8/2000 | Hoerner | |
| 6,200,185 B1 | | 3/2001 | Kuster, Jr. | |

* cited by examiner

*Primary Examiner*—Jacob K. Ackun
*Assistant Examiner*—Bena B. Miller
(74) *Attorney, Agent, or Firm*—McCarter & English, LLP

(57) ABSTRACT

A flying disk toy is provided with a streamer, windsock or the like for aesthetically enhancing the visual effect of the flying disk toy while in flight with minimal interference to its flight aerodynamics. The flying disk toy is in the form of a substantially disk-shaped body having an outer rim, a generally convex top surface, a generally concave bottom surface, and a central axis about which the body rotates when the disk toy is in flight. The streamer includes a leading end and a trailing end. The streamer may be illuminated while the disk toy is in flight. The streamer may also be positioned such that its leading end is adjacent to the outer rim of the disk body. If a hanger arm is employed to attach the streamer to the disk body, the hanger arm can be mounted in an anti-friction bearing position in the top surface of the disk body, whereby the hanger arm and the streamer are rotatable relative to the disk body.

27 Claims, 10 Drawing Sheets

$I_{TOP} = I_{BOTTOM}$

FLYING DISK TOY

FIELD OF THE INVENTION

The present invention relates to flying disk toys and, more particularly, to such toys having pivotal streamers or banners mounted thereon for aesthetically enhancing the visual effect of the flying disk toy while in flight with minimal interference to its flight aerodynamics.

BACKGROUND OF THE INVENTION

Flying disk toys having visual enhancements are well known in the prior art. Such visual enhancements have included streamers, lights, propellers and the like. By adding such visual enhancements, the flight aerodynamics of the disk toys are, however, drastically impaired, whereby flight stability, flight direction, and/or flight duration are detrimentally effected and/or curtailed.

The prior art describes various efforts to produce visual enhancement devices for flying disk toys. In all instances, however, such visual enhancement devices impair the flight characteristics of the flying disk toys.

For example, U.S. Pat. No. 4,209,936 to Sklar discloses a flying saucer disk having a flexible tail and pivot means for attaching one end of the tail to the disk at its central axis. When the disk is rotating in flight, the tail trails while remaining extended in the direction opposite to the direction of flight. The pivot means and tail present a hindrance in the form of additional asymmetrical drag, as the pivot means and tail affect the upper airstream on the outer skin surface of the disk, and the asymmetrical drag tilts the front edge of the disk upward.

U.S. Pat. No. 6,200,185 to Kuster, Jr. discloses a flying disk toy having a display panel. The flying disk toy includes a coupling means for attaching the display panel to a centrally located cylindrical pin guide which allows for the display panel to rotate relative to the disk. The display panel presents a hindrance to the flight aerodynamics in the form of additional asymmetrical drag and flight stability, as the display panel affects the upper airstream on the outer skin surface of the flying disk toy, and the drag tilts the front lip of the disk upward.

U.S. Pat. No. 4,778,428 to Wield discloses an illuminated flying saucer toy having a pair of LED's mounted in a diametrically opposed relationship relative to each other on the rim of its disk-shaped body. The disk-shaped body includes a centrally located circuit board housing having a plurality of decorative nails mounted thereon.

Accordingly, there remains a need for an improved flying disk toy having pivotal streamers thereon for enhancing the visual effects of the flying disk while in flight, but minimizes any deviations during its flight with regard to flight stability, direction and duration by minimizing any changes to the flight aerodynamics of the visually-enhanced flying disk toy.

In the foregoing circumstances, it is an object of the present invention to provide a flying disk toy having visual enhancements that minimize any distortion to its flight aerodynamics during use.

Another object of the present invention is to provide an improved flying disk toy that minimizes any impairment of flight stability, flight direction and flight duration (distance) because of the visual enhancement device mounted thereon.

SUMMARY OF THE INVENTION

In accordance with the present invention, there is provided a flying disk toy having visual enhancement means mounted thereon for aesthetically enhancing the visual effect of the flying disk toy while in flight with minimal interference to its flight aerodynamics. The flying disk toy includes a substantially disk-shaped body having an outer rim, a generally convex top surface, a generally concave bottom surface, and a central axis about which the disk body rotates when the disk toy is in flight. The visual enhancement means includes a streamer which flaps and/or flutters in flight. As used herein, the term "streamer" includes a ribbon-like element, a flag, a banner, a pennon, a pennant, or a windsock. Preferably, the streamer is arranged so that its width is generally perpendicular to the top surface of the disk toy.

In one embodiment, the flying disk toy includes attachment means in the form of a substantially flexible string member having a swivel connector at one end and a loop member at the other end. The swivel connector is attached to a leading end of the streamer, such that the leading end of the streamer is positioned adjacent to the outer rim of the disk body. The loop member is attached to mounting means in the form of a mounting post, such that the loop member is rotatable relative to the disk body.

In another embodiment, the flying disk toy includes attachment means in the form of a substantially rigid hanger arm, one end of which is attached to a leading end of the streamer. The opposite end of the hanger arm is attached to a bearing member, such that the hanger arm is rotatable relative to the disk body. By locating the bearing member in a recessed area in the top surface of the disk body, within an equi-inertial plane that bisects the bearing member one can minimize the detrimental effects of the drag force caused by the streamer and the hanger arm.

In yet in another embodiment, the flying disk toy is provided with illumination means which function to illuminate the streamer when the disk toy is in flight. Typically, the illumination means includes a light source, a reflector, power means and a switch.

BRIEF DESCRIPTION OF THE DRAWINGS

Further objects, features and advantages of the present invention will become apparent upon consideration of the following detailed description of the exemplary embodiments considered in connection with the accompanying drawings, in which.

DETAILED DESCRIPTION OF THE EXEMPLARY EMBODIMENTS

First Exemplary Embodiment 10

Figure 3:
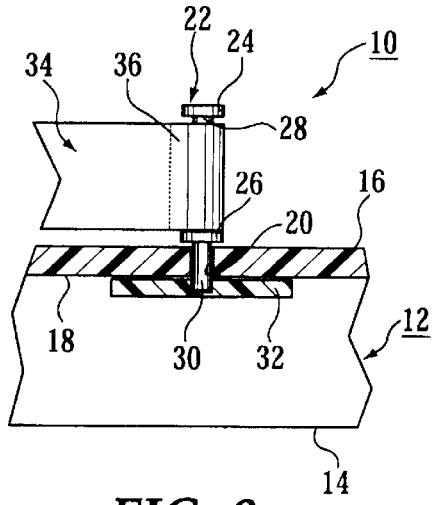
FIG. 3 is a partial cross-sectional view of the flying disk toy of FIG. 1 showing, in detail, a ribbon post having a streamer thereon.
Figure 4A:
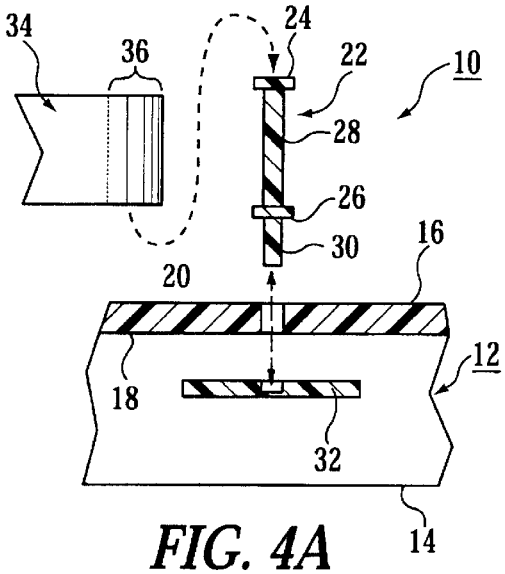
FIG. 4A is an exploded cross-sectional view of the flying disk toy of FIGS. 1–3 showing, in detail, the ribbon post, the streamer and a mounting plate.
Figure 4B:
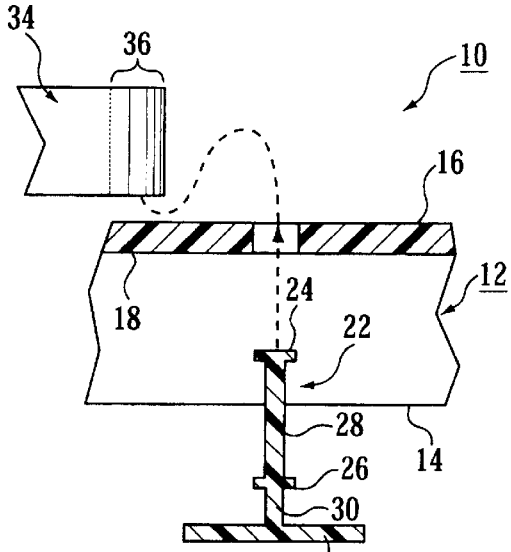
FIG. 4B is an exploded cross-sectional view of the flying disk toy of FIGS. 1–3 showing, in detail, the ribbon post, the streamer and a mounting plate.
Figure 4C:
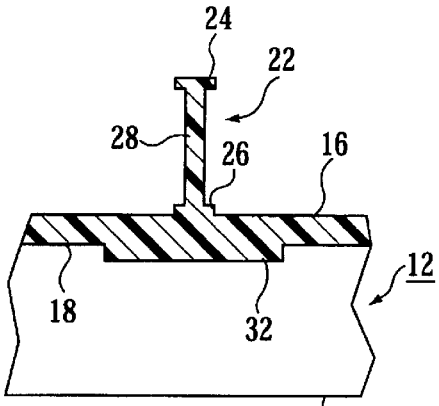
FIG. 4C is an enlarged cross-sectional view similar to FIG. 4A, except that the ribbon post is formed as an integral component of the flying disk toy.
Figure 5:
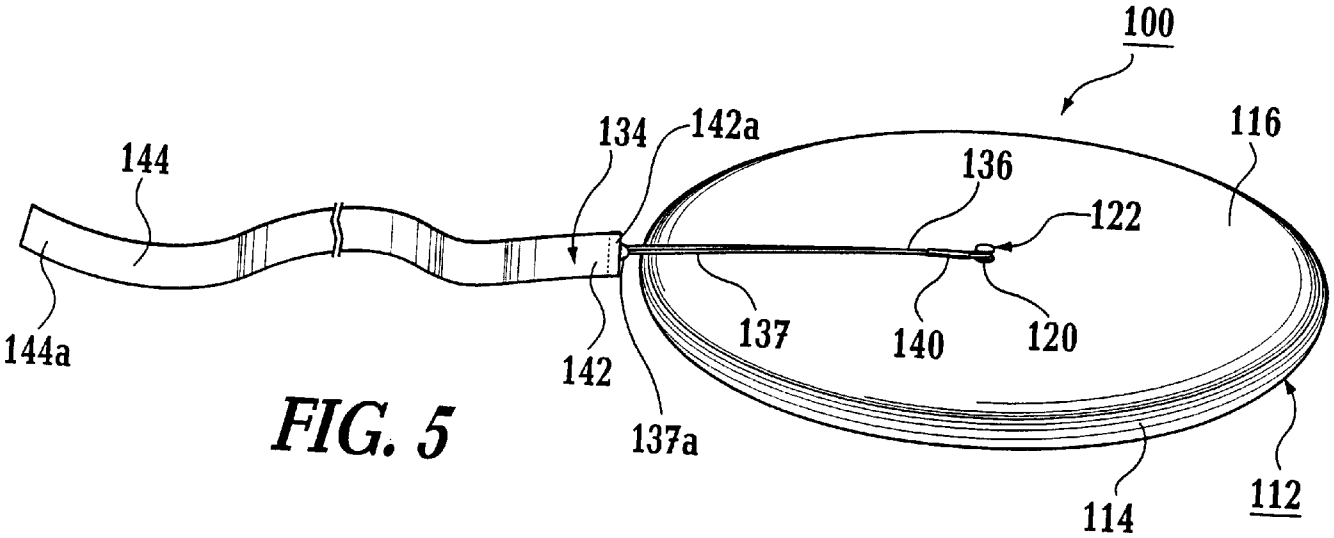
FIG. 5 is a top perspective view of a flying disk toy constructed in accordance with a second exemplary embodiment of the present invention.
Figure 6:
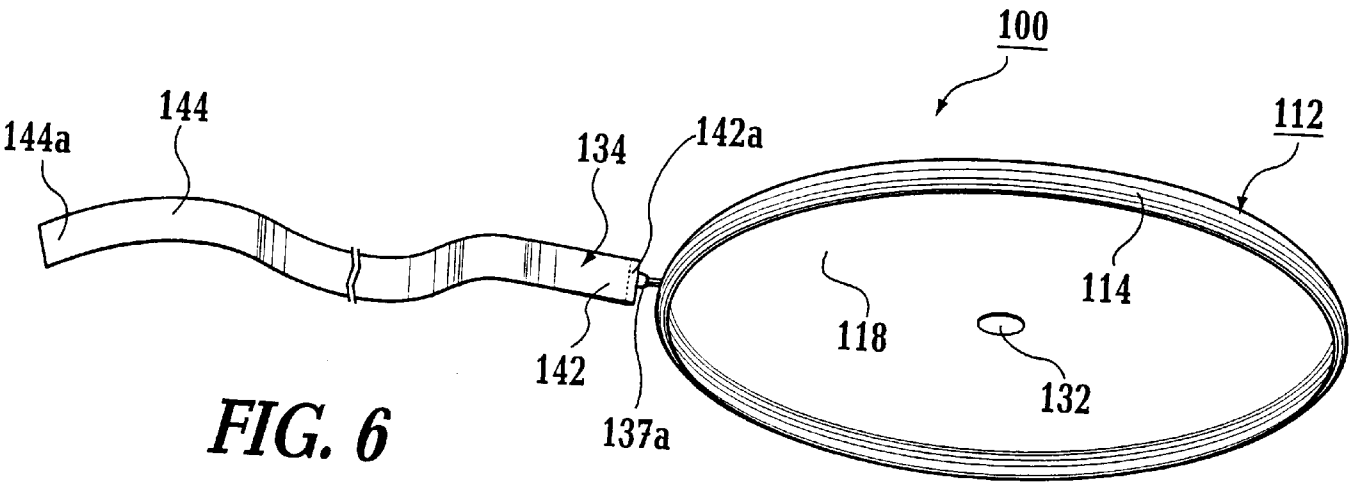
FIG. 6 is a bottom perspective view of the flying disk toy of FIG. 5.
Figure 7:
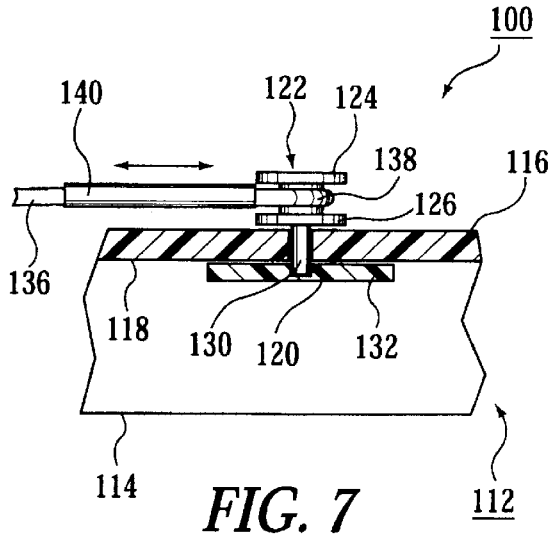
FIG. 7 is a partial cross-sectional view of the flying disk toy of FIG. 5 showing a ribbon post thereon.

Referring to FIGS. 1 through 4A to 4C, there is shown a flying disk toy 10 constructed in accordance with a first embodiment of the present invention. The flying disk toy 10 includes a disk-shaped body 12 terminating at its periphery in a downwardly extending rim 14. The disk-shaped body 12 includes a substantially convex top surface 16 and a substantially concave bottom surface 18. The disk-shaped body 12 also includes a cylindrically-shaped opening 20 located at its central axis (see FIGS. 1, 3 and 4A) for receiving a slender and elongated ribbon mounting post 22 therethrough. The ribbon post 22 includes upper and lower flanged ends 24, 26, which are separated by a center post section 28, as shown in FIG. 3. The ribbon post 22 further includes a lower post section 30 extending within opening 20 and a reinforcement plate 32 attached to the bottom surface 18 of body 12 about its central axis (see FIGS. 2 and 3). The ribbon post 22 can be molded as an integral (i.e., monolithically formed) component of the disk-shaped body 12 (see FIG. 4C), or as two separate elements to be attached and glued after the initial molding of the flying disk toy has been completed (see FIG. 4A), or as a single element to be attached and glued after the initial molding of the flying disk toy 10 has been completed (see FIG. 4B). The ribbon post 22 is used for attaching a ribbon-like streamer 34 thereto (see FIGS. 1 and 3). The streamer 34 includes a slip-on sleeve section 36 for removably attaching to the center post section 28 of the ribbon post 22. The sleeve section 36 is allowed to pivot about the center post section 28 between the upper and lower flanged-ends 24, 26 of the ribbon post 22 (see FIG. 3). The streamer 34 also includes a tail section 38 that oscillates and flutters when the flying disk toy is in flight for enhancing the visual effect of the disk during its flight. The streamer 34 is made from light-weight materials such as rayon, nylon, polyester, silk and the like.

In operation, the elongated and slender ribbon post 20 does not present a hindrance to the flight aerodynamics of disk 10 and minimizes the asymmetrical drag associated with the design, size and shape of the attachment (ribbon post 22), as there is little affect on the upper airstream along the top surface 16 of the flying disc toy 10 as the body 12 rotates in flight. Thus, the ribbon post 22 and streamer 34 have little or no affect on the disk's flight aerodynamics with regard to flight stability, flight direction (going left or right) or flight duration (time and distance of flight when the disk is thrown).

Figure 1:
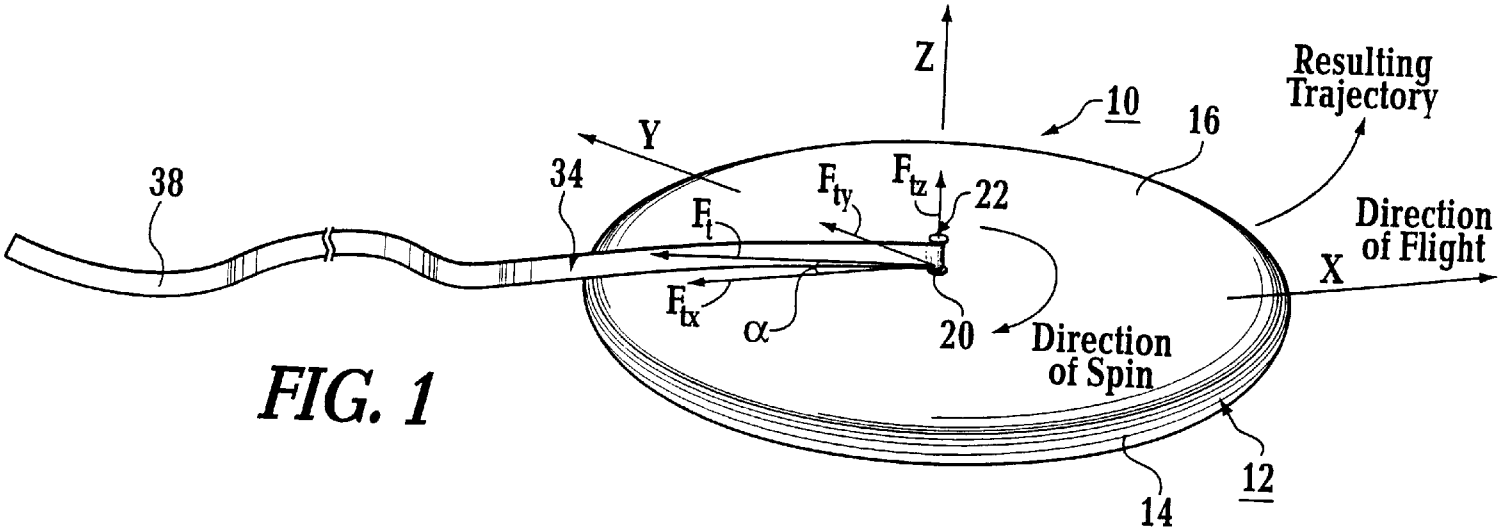
FIG. 1 is a top perspective view of a flying disk toy constructed in accordance with a first exemplary embodiment of the present invention.
Figure 2:
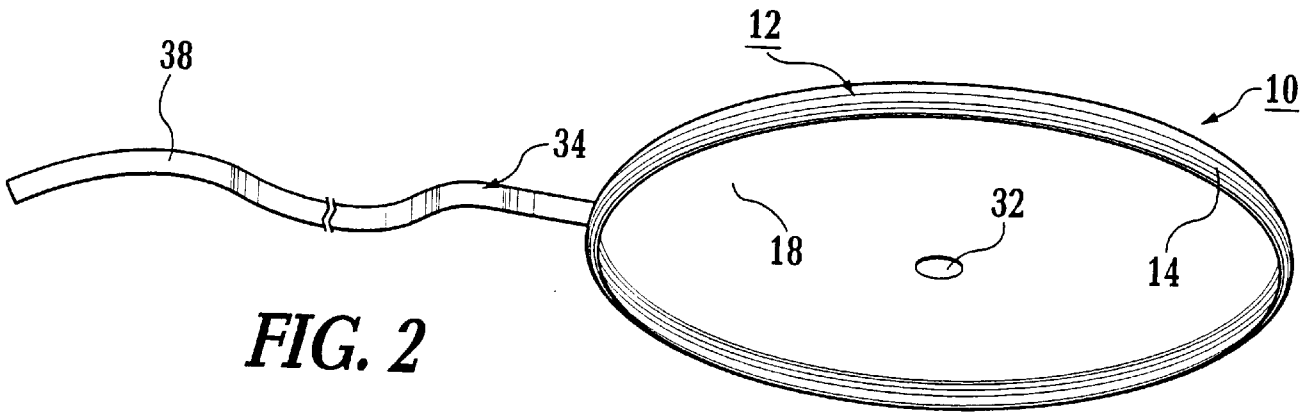
FIG. 2 is a bottom perspective view of the flying disk toy of FIG. 1.

With further reference to the operation of the present invention, the following discussion provides an additional scientific explanation of the flight aerodynamics of the flying disk toys with attachments (see FIG. 1).

$$F_{tx}=F_t \cos \alpha$$

$$F_{ty}=F_t \sin \alpha$$

where:

$F_t$=trailing (drag) force caused by an attachment (i.e., ribbon post and streamer);

$F_{tx}$=the X component of $F_t$;

$F_{ty}$=the Y component of $F_t$; and $\alpha$=the angle between $F_t$ and the direction of flight (X-axis in our coordinate system).

The friction in the pivot forces the attachment to be at a slight angle $\alpha$ with regard to the X-axis (see FIG. 1). Both $F_{tx}$ and F create torques, tilting the disk during the flight. Their effects are minimal at the beginning of the flight because the angular momentum of the disk is high, and, therefore, its stability is high due to the well-known gyroscopic effect. As the flight progresses, the angular momentum decreases because of the drop of angular velocity due to air friction. As a result, the stability is decreasing and the effects of $F_{tx}$ and $F_{ty}$ are growing.

The torque created by $F_{tx}$ tilts up the front lip of the disk, increasing the "angle of the attack". Generally speaking, this effect is positive since it takes action at the end of the flight when linear velocity drops and aerodynamic lift due to Bernoulli effect drops too. The increase of the angle of the attack helps to boost aerodynamic lift and prolong the flight.

The effect of $F_{ty}$, however, is negative because of the following reasons:

1) It drags the disc leftward, although this effect is negligible as the flight tests have shown.

2) The torque created by $F_{ty}$ has a much stronger detrimental effect on the flight of the disk toy. This torque twists the disk counterclockwise if viewed from behind. It is significantly higher than the well-known clockwise torque caused by the asymmetrical lift of a spinning disk without an attachment due to Bernoulli effect. Together $F_{cx}$ and $F_{ty}$ force the angle of the attack plane to be at the angle a with the flight direction. Due to the sailing effect, the disc deflects to the left (see FIG. 1). This conclusion has been very consistent with flight tests on the present invention, such that the greater the torque, created by $F_t$, the steeper the left turn of the disc. This was done by elevating the point of application of $F_t$ above the disk plane. It is noted that the disk with opposite spin makes a right turn. Based on the above-described flight aerodynamic findings, the design of the present invention minimizes the detrimental effects of attachments, such as the ribbon post 22 and streamer 34 shown in the first exemplary embodiment 10. It is noted that the foregoing explanation applies also to the second exemplary embodiment 100 described hereinafter.

Second Exemplary Embodiment 100

A second exemplary embodiment 100 of the present invention is illustrated in FIGS. 5 through 8A to 8C. Elements illustrated in FIGS. 5–8C which correspond to the elements described above with reference to FIGS. 1–4C have been designated by corresponding reference numerals increased by one hundred. The embodiment 100 of FIGS. 5–8C is constructed and operates in the same manner as the first embodiment 10 of FIGS. 1–4C, unless otherwise stated.

Figure 8A:
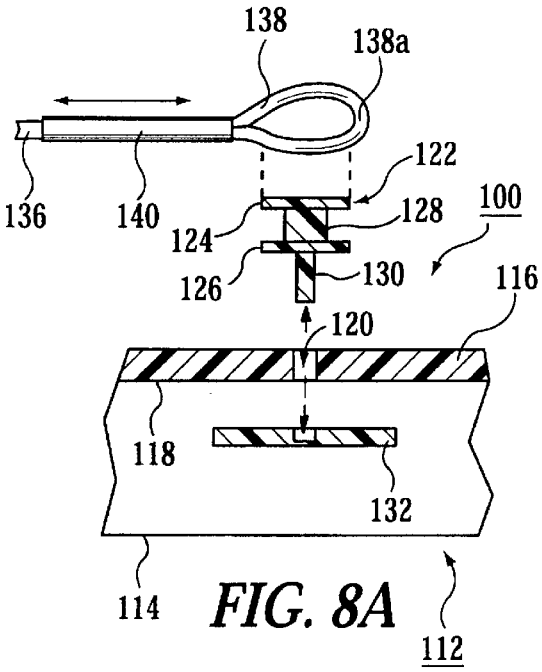
FIG. 8A is an exploded cross-sectional view of the flying disk toy of FIGS. 5–7 showing, in detail, the ribbon post and the mounting plate.
Figure 8B:
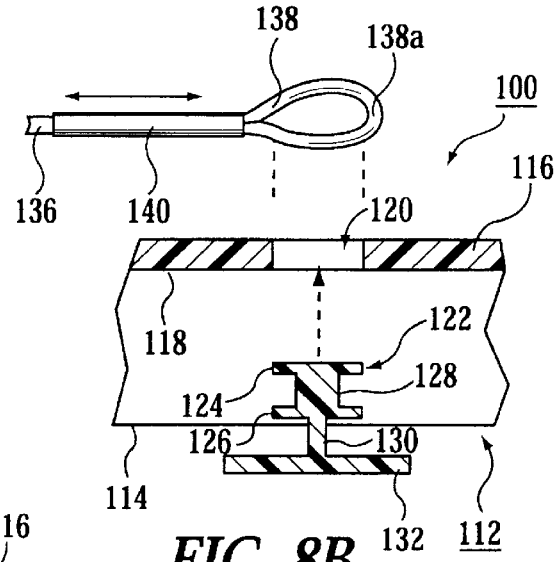
FIG. 8B is an exploded cross-sectional view of the flying disk toy of FIGS. 5–7 showing, in detail, the ribbon post and the mounting plate.
Figure 8C:
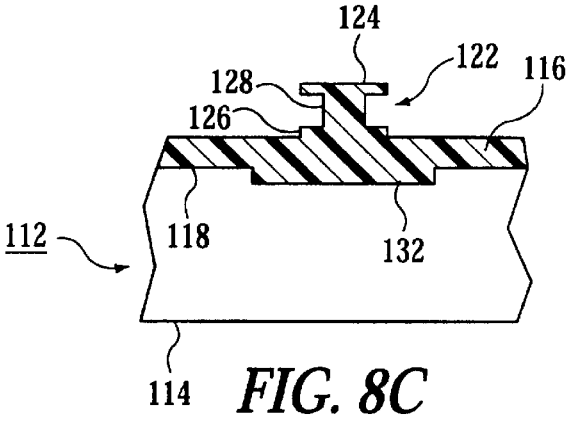
FIG. 8C is an enlarged cross-sectional view similar to FIG. 8A, except that the ribbon post is formed as an integral component of the flying disk toy.

With the foregoing prefatory comments in mind, the disk-shaped body 112 includes a cylindrically-shaped opening 120, located at its central axis (see FIGS. 1, 7 and 8) for receiving a squat and short ribbon mounting post 122 therethrough. The ribbon post 122 includes upper and lower flanged ends 124, 126, which are separated by a center post section 128, as depicted in FIG. 8A. The ribbon post 122 further includes a lower post section 130 extending within opening 120 and a reinforcement plate 132 attached to the bottom surface 118 of body 112 about its central axis (see FIGS. 7 and 8A). The ribbon post 122 can be molded as integral (i.e., monolithically formed) component of the disk-shaped body 112 (see FIG. 8C), or as two separate elements to be attached and glued after the initial molding of the flying disk toy 100 has been completed (see FIG. 8A) or as a single element to be attached and glued after the initial molding of the flying disk toy 100 has been completed (see FIG. 8B). The ribbon post 122 is used for attaching a ribbon-like streamer 134 thereto (see FIGS. 5 and 8A). The streamer 134 also includes a leading end 142 and a trailing end 144, wherein the leading end is a holding element 142*a* and the trailing end 144 is a tail section 144*a*. The streamer 134 also includes attachment means in the form of a string member 136 having a first end 137 and a second end 138. The second end 138 is provided with a loop member 138*a* and an adjustable harness member 140 for removably attaching to the center post section 128 between the upper and lower flanged ends 124, 126 of ribbon post 122 (see FIGS. 7 and 8A). The first end 137 is in the form of swivel connector 137*a* for connecting to the holding element 142*a* of streamer 134. The swivel connector 137*a* of streamer 134 facilitates the oscillating and fluttering of the tail section 144*a* when the flying disk toy 100 is in flight, thus enhancing the visual effects of the disk during its flight (see FIG. 5). The streamer 134 and the string member 136 are also made from lightweight materials such as rayon, nylon, polyester, silk and the like.

In operation, the short ribbon post 122 does not present a hindrance to the flight aerodynamics of disk 100 and minimizes the asymmetrical drag associated with the design, size and shape of the attachment (ribbon post 122), as there is little to affect the upper airstream along the top surface 116 of the flying disk toy 100 as the body 112 rotates in flight. Thus, the ribbon post 122 and streamer 134 have little or no affect on the disk's flight aerodynamics with regard to flight stability, flight direction, or flight duration. In addition to the foregoing description of operation of disk 100, the scientific principles of flight aerodynamics provided in connection with the first exemplary embodiment 10 of the present invention apply equally to the second exemplary embodiment 100.

Third Exemplary Embodiment 200

Figure 9:
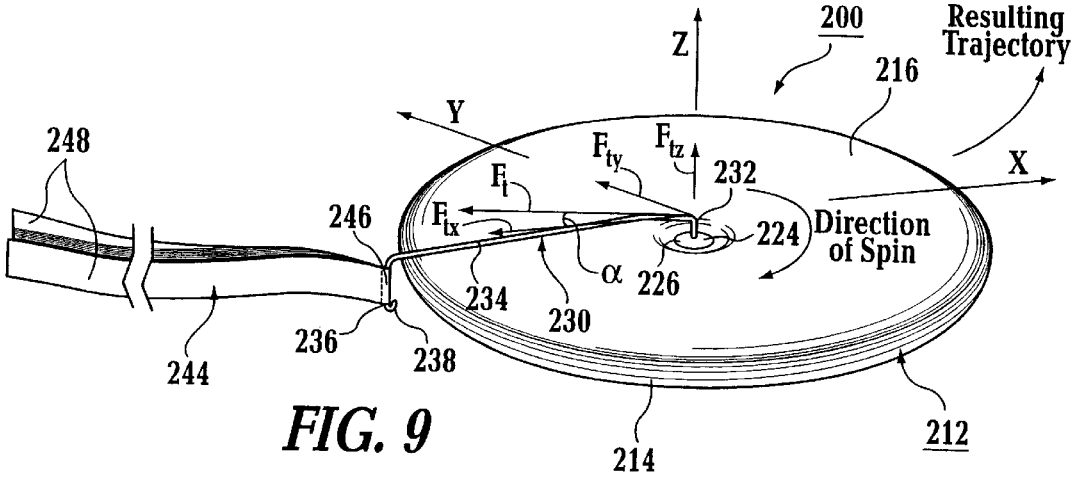
FIG. 9 is a top perspective view of a flying disk toy constructed in accordance with a third exemplary embodiment of the present invention.
Figure 10:
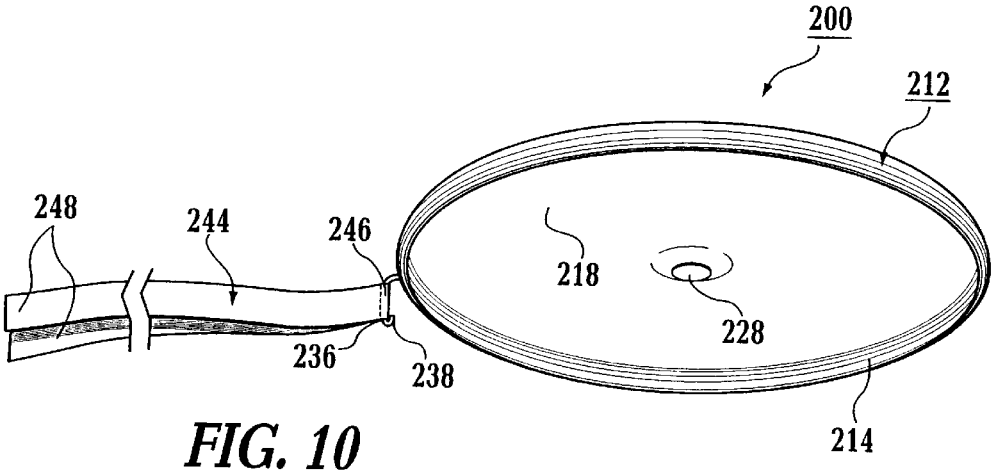
FIG. 10 is a bottom perspective view of the flying disk toy of FIG. 9.
Figure 11:
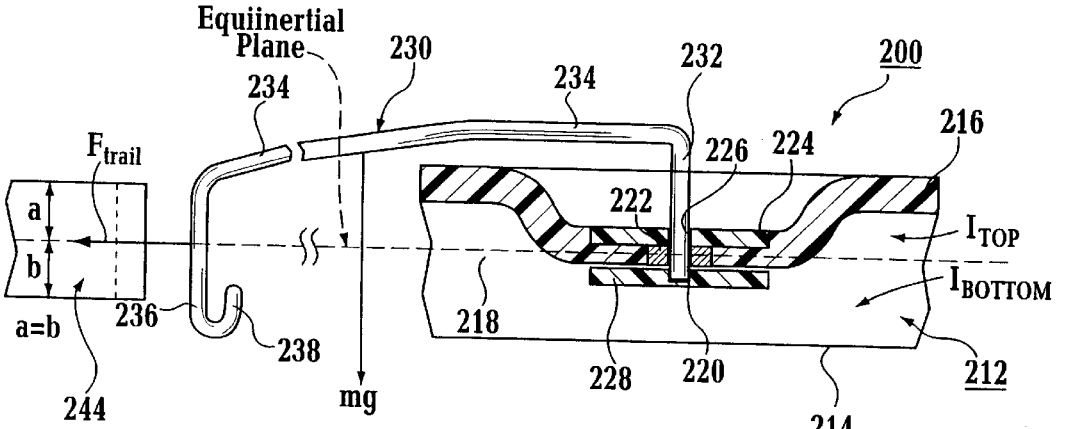
FIG. 11 is a partial cross-sectional view of the flying disk toy of FIGS. 9 and 10 showing a ribbon arm on the topside of the flying disk toy.
Figure 12:
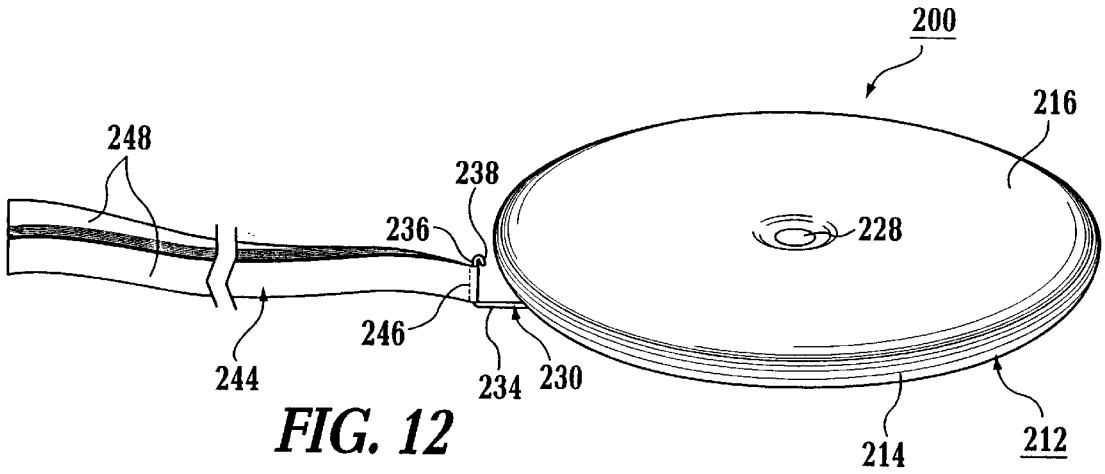
FIG. 12 is a top perspective view similar to FIG. 9, except that the ribbon arm is on the underside of the flying disk toy.
Figure 13:
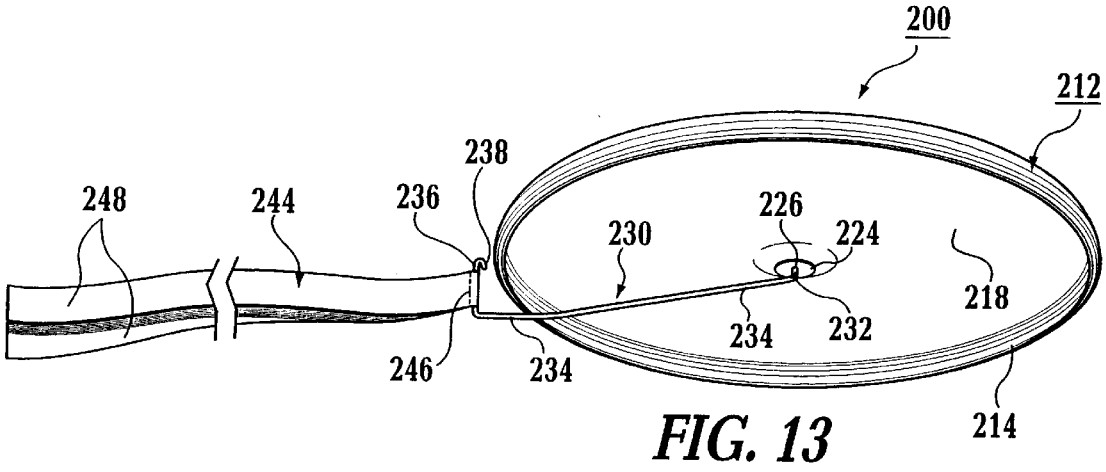
FIG. 13 is a bottom perspective view of the flying disk toy of FIG. 12.
Figure 14:
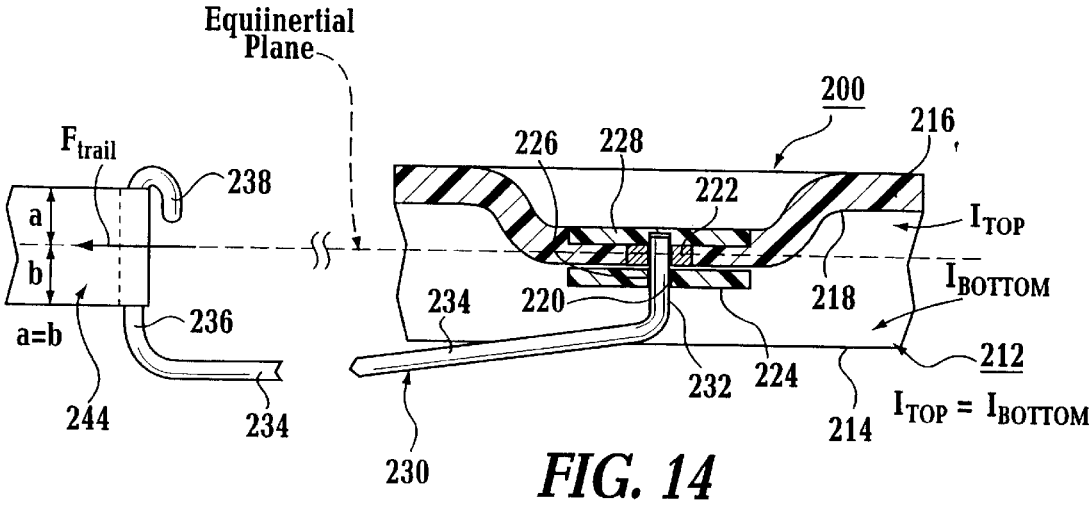
FIG. 14 is a partial cross-sectional view of the flying disk toy of FIGS. 12 and 13 showing the ribbon arm on the underside of the flying disk toy.
Figure 15:
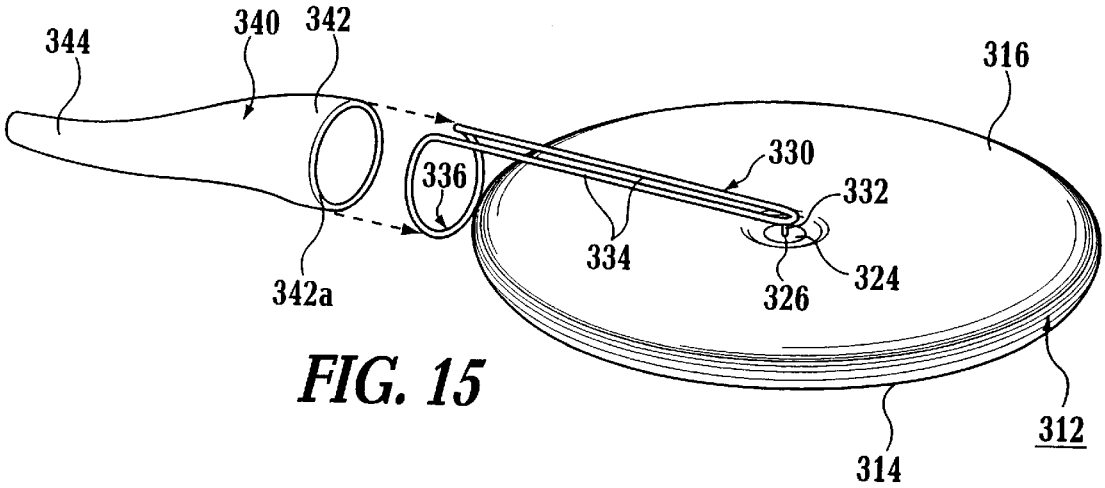
FIG. 15 is a top perspective view of a flying disk toy constructed in accordance with a fourth exemplary embodiment of the present invention.

A third exemplary embodiment 200 of the present invention is illustrated in FIGS. 9 through 14. Elements illustrated in FIGS. 13 and 14 which correspond to the elements described above with reference to FIGS. 1–4C have been designated by corresponding reference numerals increased by two hundred. The third embodiment 200 of FIGS. 9 and 11 is constructed and operates in the same manner as the first embodiment 10 of FIGS. 1–4C, unless otherwise stated.

With the foregoing prefatory comments in mind, the disk-shaped body 212 includes a cylindrically-shaped opening 220 located at its central axis (see FIGS. 13 and 14) for receiving a bearing member 222 therethrough. The bearing member 222 includes a cover member 224 having an attachment opening 226 therein, and a mounting plate 228 (see FIGS. 13 and 14). The bearing member 222 is attached to a ribbon hanger arm 230, which is an elongated substantially U-shaped structure having a vertical attachment section 232, a horizontal center section 234 and a vertical ribbon holding section 236 for holding and attaching of one or more streamers 244 thereon. The holding section 236 includes a hook element 238 to prevent the detachment of the streamer 244 from the ribbon holding section 236 (see FIGS. 10 and 12). The attachment opening 226 of cover member 224 receives the vertical attachment section 232 therethrough (see FIGS. 13 and 14). The sections 232, 234 and 236 of ribbon arm 230 are integrally connected with each other. Thus, the ribbon arm 230 can be formed from extruded light-weight metal wire or from moldable plastic materials. It should be understood that the ribbon arm 230 can be mounted above the top surface 216 of disk 200 or can be mounted below the bottom surface 218 of disk 200 (See FIGS. 9 and 12) without hindering the performance to the disk's flight aerodynamics.

In operation, the ribbon arm 230 does not present a hindrance to the flight aerodynamics of disk 200 and minimizes the asymmetrical drag associated with the design, size and shape of the attachment (ribbon arm 230), as there is little to affect the upper airstream which flows along the top surface 216 when the ribbon arm 230 is mounted on the top side of disk 200. Also, there is little to affect the lower airstream which flows along the bottom surface 218 when the ribbon arm 230 is mounted on the bottom side of disk 200. Thus, the ribbon arm 230 and streamer 244 have little or no affect on the disk's flight aerodynamics with regard to flight stability, flight direction or flight duration.

While the flight aerodynamics described in connection with the operation of the first exemplary embodiment 10 also apply to the third exemplary embodiment 200, the following description provides a further scientific explanation of the flight aerodynamics of the disk toy 200 (see FIG. 11). The following equations describe the precise location of an equi-inertial plane that divides the disk 200 into two sections each having equal moments of inertia.

$$I_{top} = \sum_i m_{itop} r_{itop}^2$$

$$I_{bottom} = \sum_i m_{ibottom} r_{ibottom}^2$$

$$I_{top} = I_{bottom}$$

where:

$I_{top}$=the moment of inertia of the top section of the disk;

$I_{bottom}$=the moment of inertia of the bottom section of the disk; and $I_{top}$=$I_{bottom}$: this equation defines where the equiinertial plane of the disk toy resides.

The above equations describe the flying disk toy 200 of the third exemplary embodiment which minimizes the detrimental effects of drag caused by the attachments (ribbon arm 230 and streamer 244) as shown in FIG. 11. To reduce $F_{ty}$, a low friction bearing member 222 is used. Further, to minimize the effects of $F_{ty}$ and $F_{tx}$ torques, $F_{ty}$ and $F_{tx}$ should lie in the equi-inertial plane of the disk toy 200. To achieve this effect, the bearing member 222 and the streamer 244 are in the equi-inertial plane (see FIGS. 9 and 11). As shown in FIG. 11, the equi-inertial plane divides bearing member 222 in half, such that (½) half of the bearing member 222 is above the equi-inertial plane and the other (½) half of the bearing member 222 is below the equi-inertial plane. In reference again to FIG. 11, the streamer 244 on the vertical ribbon holding section 236 has the equi-inertial plane dividing the sleeve section 246 of streamer 244 in half, such that (½) half of sleeve section 246 is above the equi-inertial plane (designated by reference letter "a") and the other (½) half of sleeve section 246 is below the equi-inertial plane (designated by reference letter "b"), wherein "a" equals "b". As previously described, the placement of the 10. bearing member within the equi-inertial plane having the top moment of inertia ($I_{top}$) equal to the bottom moment of inertia ($I_{bottom}$), minimizes the detrimental effects of the drag force ($F_{trail}$) caused by the ribbon arm 230 and streamer 244 attachments. If the trail force $F_t$ is applied, as shown in FIG. 9, the disturbance caused by the aforementioned attachments to the gyroscopic motion of the disk 200 is minimal. In this embodiment, only the torque created by the gravitational force (mg) exerted on the ribbon arm 230 would not be minimized (see FIG. 11). For example, if the ribbon arm 230 had a weight of 7.5 grams, the disk 200 showed a tendency to turn towards the left (see FIG. 11). When the ribbon arm 230 weight was reduced to 3.5 grams, the disk 200 showed a perfectly straight flight direction, better than the flight of a disk without any attachments. This reduction of weight to the ribbon arm 240 indicates that the torque created by the ribbon arm's weight was compensated for by the aforementioned asymmetrical lift caused by the spin of the disk 200. It is noted that the foregoing explanation applies also to the fourth and fifth embodiments 300, 400 described hereinafter.

Fourth Exemplary Embodiment 300

Figure 16:
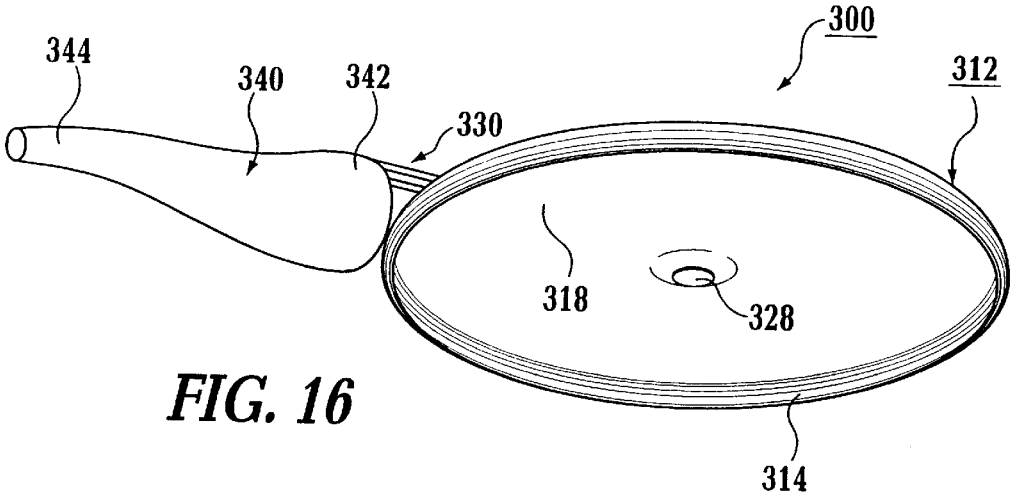
FIG. 16 is a bottom perspective view of the flying disk toy of FIG. 15.
Figure 17:
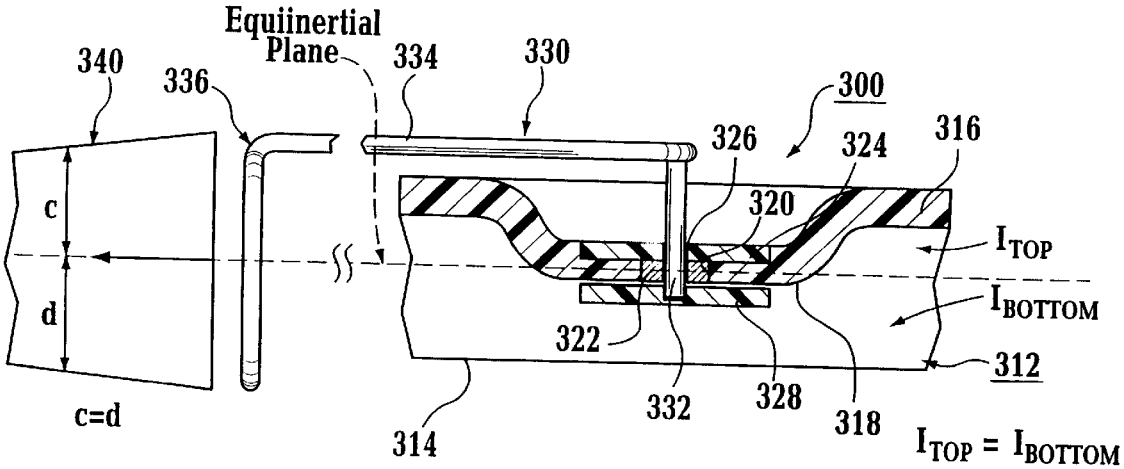
FIG. 17 is a partial cross-sectional view of the flying disk toy of FIGS. 15 and 16 showing a ribbon arm on the topside of the flying disk toy.
Figure 18:
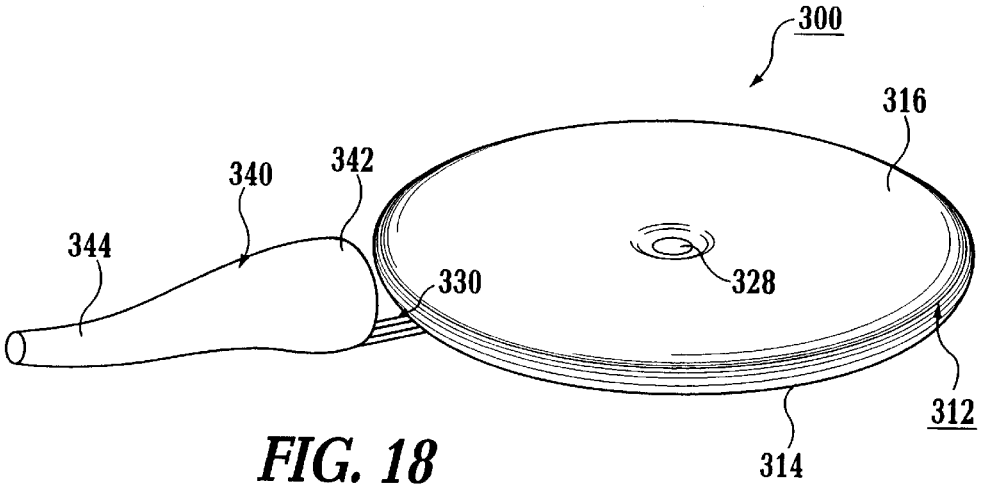
FIG. 18 is atop perspective view similar to FIG. 15, except that the ribbon arm is on the underside of the flying disk toy.
Figure 19:
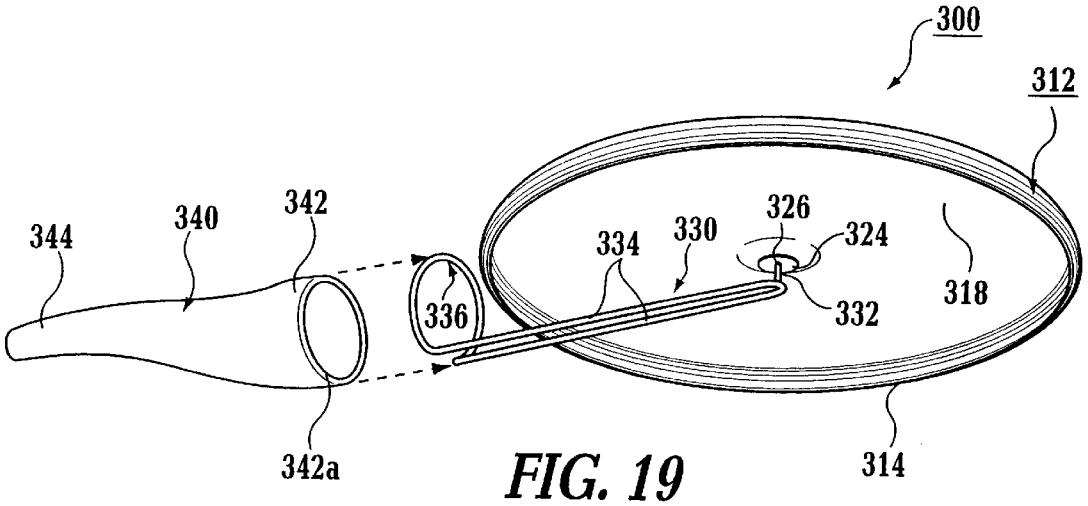
FIG. 19 is a bottom perspective view of the flying disk toy of FIG. 18.
Figure 20:
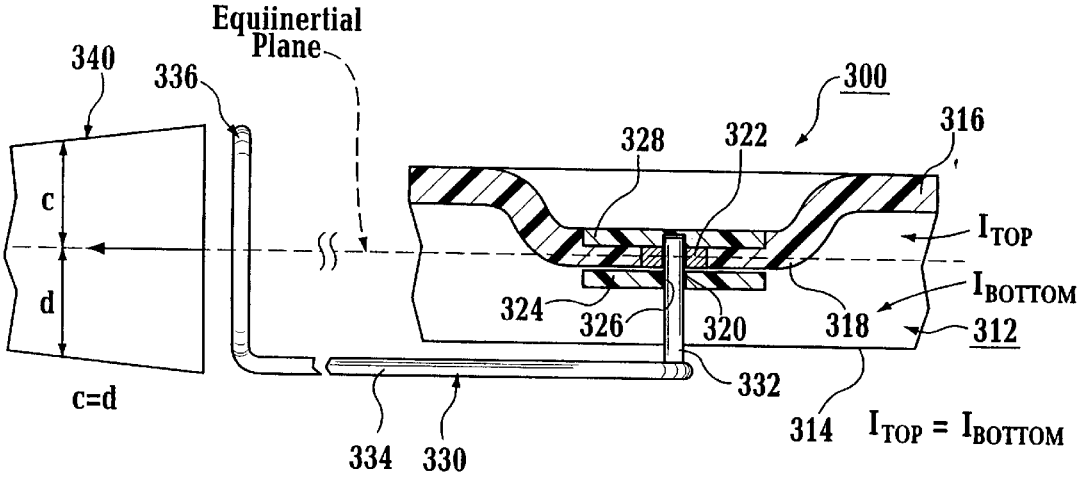
FIG. 20 is a partial cross-sectional view of the flying disk toy of FIGS. 18 and 19 showing the ribbon arm on the underside of the flying disk toy.
Figure 21:
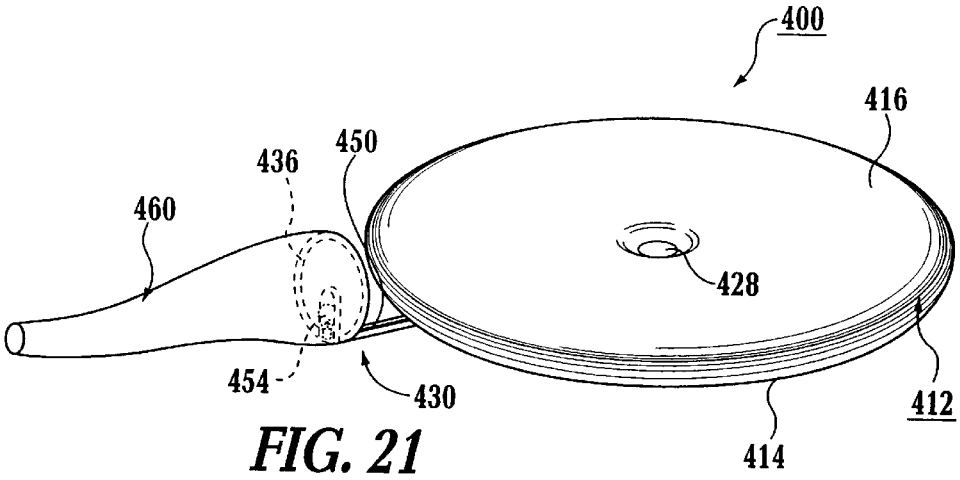
FIG. 21 is a top perspective view of a flying disk toy constructed in accordance with a fifth exemplary embodiment of the present invention.
Figure 22:
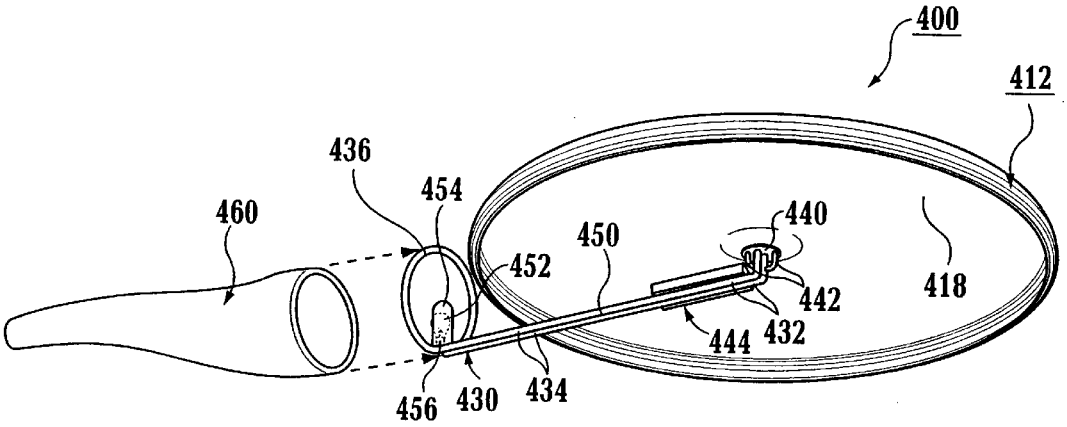
FIG. 22 is a bottom perspective view of the flying disk toy of FIG. 21.
Figure 24:
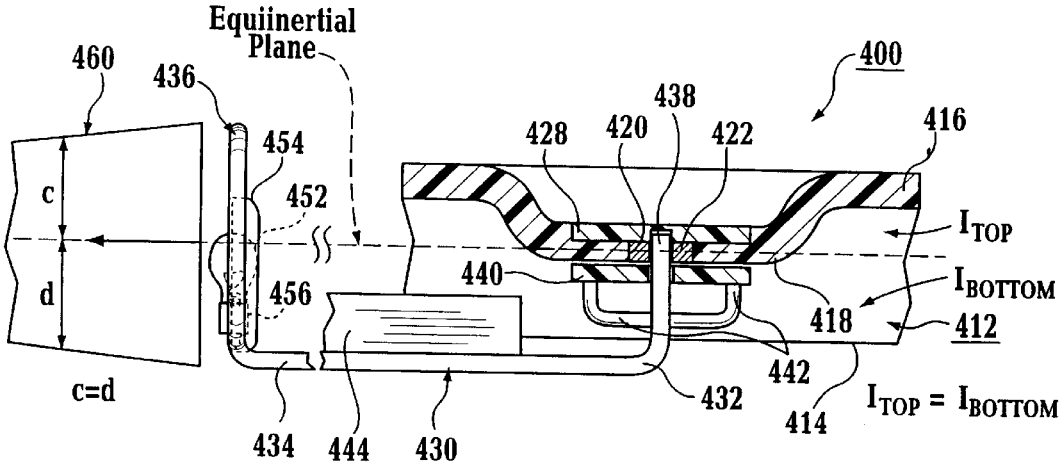
FIG. 24 is a partial cross-sectional view of the flying disk toy of FIGS. 21 and 22 showing the ribbon arm on the underside of the flying disk toy.
Figure 23:
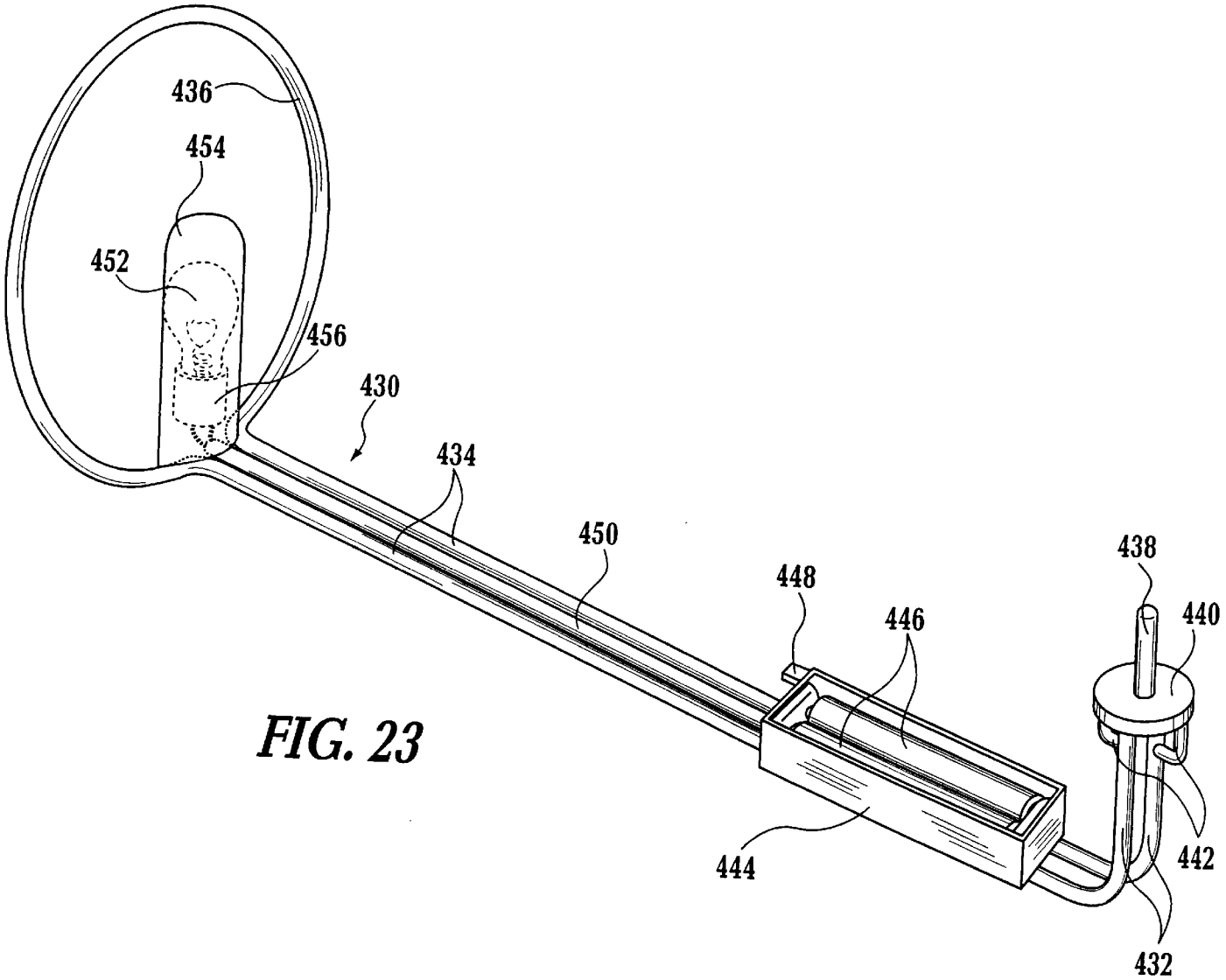
FIG. 23 is a top perspective view of a ribbon arm/light assembly employed by the flying disc toy of FIGS. 21 and 22.

A fourth exemplary embodiment 300 of the present invention is illustrated in FIGS. 15–20. Elements illustrated in FIGS. 15 to 20 which correspond to the elements described above with reference to FIGS. 1–4C have been designated by corresponding reference numerals increased by three hundred. The fourth embodiment 300 of FIGS. 16 and 17 is constructed and operates in the same manner as the first embodiment 10 of FIGS. 1–4C, unless otherwise stated.

With the foregoing prefatory comments in mind, the disk-shaped body 312 includes a cylindrically-shaped opening 320 located at its central axis (see FIGS. 19 and 20) for receiving a bearing member 322 therethrough. The bearing member 322 includes a cover member 324, having an attachment opening 326 therein, and a mounting plate 328 (see FIGS. 19 and 20). The bearing member 322 is attached to a windsock hanger arm 330. The windsock arm 330 is an elongated substantially U-shaped structure having a vertical attachment section 332, a horizontal center section 334 and a vertical windsock frame section 336 for holding and attaching of a windsock streamer 340 thereon. The windsock streamer 340 includes a leading end 342 and a trailing end 344, wherein the leading end 342 is a holding band 342*a*, such that the holding band 342*a* of windsock streamer 340 is attached to the frame section 336 of windsock arm 330. The attachment opening 326 of cover member 324 receives the vertical attachment section 332 therethrough (see FIGS. 19 and 20). The sections 332, 334 and 336 of the windsock arm 330 are integrally connected with each other. Thus, the windsock arm 330 can be formed from extruded lightweight metal wire or from moldable plastic materials. It should be understood that the windsock arm 330 can be mounted above the top surface 316 of disk 300 or can be mounted below the bottom surface 318 of disk 300 (see FIGS. 16 and 17) without hindering the performance of the disk's flight aerodynamics. The windsock frame section 336 has a substantially circular shape with a diameter in a range of from about 2 inches to about 4 inches. The windsock streamer 340 is made of lightweight materials, such as nylon, polyester, rayon, silk and the like, and typically has a length in a range of from about 12 inches to about 36 inches.

In operation, the windsock arm 330 does not present a hindrance to the flight aerodynamics of disk 300 and minimizes the asymmetrical drag associated with the design, size and shape of the attachment (windsock arm 330), as there is little to affect the upper airstream which flows along the top surface 316 when the windsock arm 330 is mounted on the top side of disk 300. Also, there is little to affect the lower airstream which flows along the bottom surface 318 when the windsock arm 330 is mounted on the bottom side of disk 300. Thus, the windsock arm 330 and windsock streamer 340 have little or no affect on the disk's flight aerodynamics with regard to flight stability, flight direction, or flight duration. In addition to the foregoing description of operation of disk 300, the scientific principles of flight aerodynamics provided in connection with the first exemplary embodiment 10 and the third exemplary embodiment 200 of the present invention apply equally to the fourth exemplary embodiment 300.

Fifth Exemplary Embodiment 400

A fifth exemplary embodiment 400 of the present invention is illustrated in FIGS. 21–24. Elements illustrated in FIGS. 21–24 which correspond to the elements described above with reference to FIGS. 1–4C have been designated by corresponding reference numerals increased by four hundred. The fifth embodiment 400 of FIGS. 21–24 is constructed and operates in the same manner as the first embodiment 10 of FIGS. 1–4C, unless otherwise stated.

With the foregoing prefatory comments in mind, the disk-shaped body 412 includes a cylindrically-shaped opening 420 located at its central axis (see FIG. 24) for receiving a bearing member 422 therein. The bearing member 422 is, in turn, attached to a windsock arm 430. The windsock arm 430 is an elongated substantially U-shaped structure having a vertical attachment section 432, a horizontal center section 434, and vertical windsock frame section 436. The vertical attachment section 432 includes an insert member 438, a cover member 440, and a cover frame member 442 (see FIGS. 23 and 24). The cover frame member 442 gives structural strength and integrity to the vertical attachment section 432. The center section 434 includes a battery compartment 444 having a battery member 446 therein and a switching element 448 attached thereto. The switching element 448 is a "throw" activated circuit having connector wiring 450 that activates and turns-on a light source 452 when the flying disk toy is thrown. The windsock frame section 436 includes a light source reflector member 454 having a socket holder 456 thereon for holding the light source 452 therein. Connector wiring 450 connects the switching element 448 to the socket holder 456 for electrically activating light source 452. The light source 452 may be in the form of a light bulb or a fiber optic cable. The battery member 446 can be in the form of AAA batteries, or a microbattery and the like for supplying electrical power to the switching element 448. The windsock frame section 436 is used for attaching and holding of a windsock streamer 460 thereto. The foregoing sections and components 432, 434, 436, 438, 440, 442 and 454 are integrally connected with each other. Thus, the windsock arm 430 can be formed from extruded and stamped lightweight metal wire or bar, or from moldable plastic materials. The windsock frame section 436 has a substantially circular shape with a diameter in a range of from about 2 inches to about 4 inches. The windsock streamer 460 can be made of lightweight semi-transparent fabric materials, such as nylon, polyester, rayon, silk and the like, having a length in a range of from about 12 inches to about 36 inches.

In operation, the windsock arm 430 does not hinder the flight aerodynamics of disk 400 and minimizes the asymmetrical drag associated with design, size and shape of the attachment (windsock arm 430), as there is little to affect the lower airstream which flows along the bottom surface 418 when the windsock arm 430 is mounted on the bottom side of disk 400. Thus, the windsock arm 430 and windsock streamer 460 have little or no affect on the disk's flight aerodynamics with regard to flight stability, flight direction or flight duration. Further, during operation of disk 400, after it has been thrown by a user, the switching element 448 is automatically activated and turns on the light bulb 452, which then illuminates the semi-transparent windsock streamer 460 during the disks' airborne flight. In addition to the foregoing description of operation of disk 400, the scientific principles of flight aerodynamics provided in connection with the first exemplary embodiment 10 and the third exemplary embodiment 200 of the present invention apply equally to the fifth exemplary embodiment 400.

It should be understood that the embodiments described herein are merely exemplary and that a person skilled in the art may make many variations and modifications without departing from the spirit and scope of the present invention. All such variations and modifications are intended to be included within the scope of the invention as defined in the appended claims.

What is claimed is:

1. A flying disk toy, comprising a substantially disk-shaped body having an outer rim, a generally convex top surface, a generally concave bottom surface, and a central axis about which said body rotates when said toy is in flight; visual enhancement means for aesthetically enhancing the visual effect of said toy in flight, said visual enhancement means including a leading end and a trailing end; and attachment means for attaching said visual enhancement means to said body, said attachment means including a first end attached to said leading end of said visual enhancement means such that said leading end of said visual enhancement means is positioned adjacent to said outer rim of said body, a second end opposite said first end, and mounting means for mounting said second end of said attachment means to said body such that said second end of said attachment means is rotatable relative to said body.

2. A flying disk toy in accordance with claim 1, wherein said top surface of said body includes a recessed area extending about said central axis.

3. A flying disk toy in accordance with claim 1, wherein said mounting means is located within said recessed area of said body.

4. A flying disk toy in accordance with claim 1, wherein said visual enhancement means is a streamer.

5. A flying disk toy in accordance with claim 1, wherein said visual enhancement means is a windsock.

6. A flying disk toy in accordance with claim 1, wherein said attachment means is a flexible string.

7. A flying disk toy in accordance with claim 1, wherein said mounting means is a mounting post.

8. A flying disk toy in accordance with claim 1, wherein said first end of said attachment means includes a swivel connector, whereby said visual enhancement means swivels and flutters while said toy is in flight.

9. A flying disk toy in accordance with claim 1, wherein said attachment means is a substantially rigid hanger arm.

10. A flying disk toy in accordance with claim 9, wherein said hanger arm extends along said top surface of said body.

11. A flying disk toy in accordance with claim 9, wherein said hanger arm extends along said bottom surface of said body.

12. A flying disk toy in accordance with claim 1, wherein said mounting means is a bearing member.

13. A flying disk toy, comprising a substantially disk-shaped body having an outer rim, a generally convex top surface, a generally concave bottom surface, a central axis about which said body rotates when said toy is in flight, and a recessed area in said top surface; visual enhancement means for aesthetically enhancing the visual effect of said toy in flight, said visual enhancement means including a leading end and a trailing end; and attachment means for attaching said visual enhancement means to said body, said attachment means including a first end attached to said leading end of said visual enhancement means, a second end opposite said first end, and mounting means, positioned within said recessed area of said body, for mounting said second end of said attachment means to said body such that said second end of said attachment means is rotatable relative to said body.

14. A flying disk toy in accordance with claim 13, wherein said recessed area extends about said central axis.

15. A flying disk toy in accordance with claim 13, wherein said mounting means and said first end of said attachment means lie equally within an equiinertial plane for minimizing the detrimental effects of the drag force (Ft) caused by said attachment means and said visual enhancement means on said body.

16. A flying disk toy in accordance with claim 13, wherein said mounting means is a substantially rigid hanger arm.

17. A flying disk toy, comprising a substantially disk-shaped body having an outer rim, a generally convex top surface, a generally concave bottom surface, and a central axis about which said body rotates when said toy is in flight;

visual enhancement means for aesthetically enhancing the visual effect of said toy in flight; attachment means for attaching said visual enhancement means to said body such that said visual enhancement means is positioned externally of said body; and illumination means for illuminating said visual enhancement means.

18. A flying disk toy in accordance with claim 17, wherein said visual enhancement means includes a leading end, which is attached to said attachment means such that said leading end is positioned adjacent to said outer rim of said body, and a trailing end, which is opposite said leading end; and wherein said illumination means includes a light source which is positioned on said attachment means proximate to said leading end of said visual enhancement means.

19. A flying disk toy in accordance with claim 18, wherein said illumination means further includes a light reflector mounted on said attachment means adjacent to said light source, power means electrically connected to said light source for supplying power thereto, and a switch electrically connected between said power means and said light source for activating and deactivating said light source.

20. A flying disk toy in accordance with claim 18, wherein said visual enhancement means is a windsock having a substantially circular open mouth at said leading end thereof.

21. A flying disk toy in accordance with claim 19, wherein said light switch is activated when said disk is in flight.

22. A flying disk toy in accordance with claim 18, wherein said light source is a light bulb.

23. A flying disk toy in accordance with claim 18, wherein said light source is a fiber optic cable.

24. A flying disk toy in accordance with claim 17, wherein said attachment means is a substantially rigid hanger arm.

25. A flying disk toy in accordance with claim 24, wherein said hanger arm extends along said bottom surface of said body.

26. A flying disk toy in accordance with claim 17, wherein said top surface of said body includes a recessed area extending about said central axis.

27. A flying disk toy in accordance with claim 26, further including mounting means located within said recessed area of said body.

* * * * *